US006673309B1

(12) United States Patent
Watanabe et al.

(10) Patent No.: US 6,673,309 B1
(45) Date of Patent: Jan. 6, 2004

(54) SACRIFICIAL ANODE FOR CATHODIC PROTECTION AND ALLOY THEREFOR

(75) Inventors: Kunio Watanabe, Tokyo (JP); Shozo Takeya, Ohmiya (JP)

(73) Assignee: Corrpro Companies, Inc., Medina, OH (US)

( * ) Notice: Subject to any disclaimer, the term of this patent is extended or adjusted under 35 U.S.C. 154(b) by 112 days.

(21) Appl. No.: 08/387,158

(22) Filed: Feb. 10, 1995

(51) Int. Cl.[7] ..... C22C 21/10

(52) U.S. Cl. ..... 420/540; 420/514; 148/437; 148/438; 148/439; 148/440; 148/441; 148/442; 204/293

(58) Field of Search ..... 420/437–447, 420/528, 540, 514; 204/293

(56) References Cited

U.S. PATENT DOCUMENTS

| | | | | |
|---|---|---|---|---|
| 3,172,760 A | | 3/1965 | Sakano et al. | 75/146 |
| 3,418,230 A | | 12/1968 | Rutenmiller | 204/197 |
| 3,616,420 A | | 10/1971 | Broughton | 204/197 |
| 3,878,081 A | | 4/1975 | Reding | 204/197 |
| 3,974,055 A | * | 8/1976 | Reding et al. | 204/293 |
| 4,506,485 A | | 3/1985 | Apostolos | 52/515 |
| 4,619,557 A | | 10/1986 | Salama et al. | 405/211 |
| 4,692,066 A | | 9/1987 | Clear | 405/216 |
| 4,699,703 A | | 10/1987 | Norman | 204/196 |
| 4,740,355 A | * | 4/1988 | Linder et al. | 420/540 |
| 4,880,517 A | | 11/1989 | Bennett et al. | 204/196 |
| 4,931,156 A | | 6/1990 | Dowd et al. | 204/147 |
| 4,971,838 A | | 11/1990 | Hamamura et al. | 427/422 |
| 4,990,231 A | | 2/1991 | Stewart et al. | 204/147 |
| 5,098,543 A | | 3/1992 | Bennett et al. | 204/196 |
| 5,285,967 A | | 2/1994 | Weidman | 239/80 |
| 5,292,411 A | | 3/1994 | Bartholomew et al. | 204/147 |
| 5,294,462 A | | 3/1994 | Kaiser et al. | 427/446 |
| 5,296,120 A | | 3/1994 | Bennett et al. | 204/196 |
| 5,296,667 A | | 3/1994 | Marantz et al. | 219/121.47 |
| 5,341,562 A | | 8/1994 | Furuya et al. | 29/825 |
| 5,384,164 A | | 1/1995 | Browning | 427/449 |

FOREIGN PATENT DOCUMENTS

| | | | |
|---|---|---|---|
| DE | 2555876 | | 6/1976 |
| EP | 0187127 | | 7/1986 |
| EP | 0591775 | | 9/1993 |
| ES | 436424 | | 1/1977 |
| ES | 487646 | * | 11/1980 |
| FR | 2704871 | | 5/1993 |
| GB | 2205855 | | 12/1988 |
| JP | 02-149637 | * | 6/1990 |
| JP | 04-66683 | * | 3/1992 |
| JP | 04-157128 | * | 5/1992 |
| JP | 04297643 | | 10/1992 |
| JP | 60-02174 | | 1/1994 |
| JP | 07228938 | | 2/1994 |
| JP | 07228937 | | 8/1995 |
| WO | 9701413 | | 1/1997 |

* cited by examiner

*Primary Examiner*—Sikyin Ip
(74) *Attorney, Agent, or Firm*—Renner, Otto, Boisselle & Sklar, LLP

(57) ABSTRACT

An alloy for a sacrificial anode according to a first preferred aspect of the present invention includes about 10% to about 50% of Zn, about 0.03% to about 0.6% of In, and about 0.0005% to about 0.05% of Zr. The balance may be Al and any unavoidable impurities. An alloy according to a second preferred aspect of the present application includes about 10% to about 50% of Zn, about 0.03% to about 0.6% of In, and about 0.05% to about 0.3% of Si. The balance may be Al and any unavoidable impurities. An alloy according to a third preferred aspect of the present invention includes about 10% to about 50% of Zn, about 0.03% to about 0.6% of In, and about 0.02% to about 0.2% of Ce. The balance may be Al and any unavoidable impurities. An alloy according to a fourth preferred aspect of the present invention includes about 10% to about 50% of Zn, about 0.03% to about 0.6% of In, about 0.005% to about 0.1% of Ti, and about 0.001% to about 0.02% of B. The balance may be Al and any unavoidable impurities. An alloy according to another preferred aspect of the present invention includes about 10% to about 50% of Zn and about 0.03% to about 0.6% of In. The balance may be Al and any unavoidable impurities. The present invention also relates to a reinforced concrete structure comprising a cementitious material, metal reinforcement, and a sacrificial anode, the sacrificial anode including an alloy containing Al, Zn and In.

35 Claims, No Drawings

SACRIFICIAL ANODE FOR CATHODIC PROTECTION AND ALLOY THEREFOR

FIELD OF THE INVENTION

The present invention relates to an alloy for a sacrificial anode which is suitable for corrosion protection of reinforcement in a structure built of reinforced concrete and to a reinforced concrete structure comprising the sacrificial anode.

BACKGROUND OF THE INVENTION

Reinforcement in a structure built of reinforced concrete is not substantially corroded because concrete is strongly resistant against alkali. However, the problem of corrosion arises when a reinforced concrete structure is in an environment where salt water may permeate therein. For example, such environments exist when the structure is near the sea or dusted over by chlorides for the prevention of ice accumulation.

Most cathodic protection of steel in concrete is done with impressed current systems. Impressed current systems have the inherent need for periodic maintenance which limits their attractiveness to bridge owners. However, the application of impressed current anodes requires that the anode be completely isolated from the embedded steel, otherwise short circuits will occur. Sacrificial anode systems do not have these problems.

In an attempt to solve the above-noted problem, use of a zinc alloy has been proposed in a sacrificial anode method which realizes long-term, stable and low-cost corrosion protection. However, a sacrificial anode formed of a zinc alloy has an exceedingly high potential (high positive). A low potential (high negative potential) is one of the important characteristics of a sacrificial anode.

Furthermore, pure zinc, aluminum, and aluminum-zinc alloys have been used for sacrificial cathodic protection of steel reinforcing in concrete. All of these alloys have exhibited a phenomenon called passivation while on concrete. Passivation occurs when the pH of the concrete surface decreases below the normally highly alkaline value found in concrete as a result of reactions with carbon dioxide in the air, a process called carbonation, which is a normal process. The effect of passivation is that the current output of the alloy anode decreases to a point which is no longer satisfactory to provide cathodic protection for the steel. These alloys are only satisfactory for use in very wet areas of the structure.

SUMMARY OF THE INVENTION

The alloys of the present invention do not exhibit the above-identified passivation phenomenon and maintain a satisfactory level of cathodic protection current. Accordingly, the present invention provides an alloy for a sacrificial anode which is suitable for corrosion protection of reinforcement in a structure built of reinforced concrete; namely, an alloy which enables a sacrificial anode formed thereof to have a sufficiently low potential and to cause generation of a sufficiently large amount of electricity.

An alloy for a sacrificial anode according to a first preferred aspect of the present invention includes about 10% to about 50% of Zn, about 0.03% to about 0.6% of In, and about 0.0005% to about 0.05% of Zr. The balance may be Al and any unavoidable impurities. An alloy according to a second preferred aspect of the present application includes about 10% to about 50% of Zn, about 0.03% to about 0.6% of In, and about 0.05% to about 0.3% of Si. The balance may be Al and any unavoidable impurities. An alloy according to a third preferred aspect of the present invention includes about 10% to about 50% of Zn, about 0.03% to about 0.6% of In, and about 0.02% to about 0.2% of Ce. The balance may be Al and any unavoidable impurities. An alloy according to a fourth preferred aspect of the present invention includes about 10% to about 50% of Zn, about 0.03% to about 0.6% of In, about 0.005% to about 0.1% of Ti, and about 0.001% to about 0.02% of B. The balance may be Al and any unavoidable impurities. An alloy according to another preferred aspect of the present invention includes about 10% to about 50% of Zn and about 0.03% to about 0.6% of In. The balance may be Al and any unavoidable impurities.

The present invention also relates to a reinforced concrete structure comprising a cementitious material, metal reinforcement, and a sacrificial anode, the sacrificial anode including an alloy containing Al, Zn and In. The alloy may further contain one or more of Zr, Si, Ce, Ti and B.

The present invention further relates to a method of providing cathodic protection to a reinforced concrete structure comprising providing a reinforced concrete structure comprising a cementitious material and metal reinforcement; and introducing a cathodic protection anode into the reinforced concrete structure, the anode including an alloy comprising Al, Zn and In. The method may further comprise electrically connecting the sacrificial anode to the metal reinforcement. The alloy may further contain one or more of Zr, Si, Ce, Ti and B.

The present invention also relates to a method of making a cathodically protected reinforced concrete structure comprising providing a reinforced concrete structure comprising a cementitious material and metal reinforcement; introducing a sacrificial anode into the reinforced concrete structure and electrically connecting the sacrificial anode to the metal reinforcement. The sacrificial anode includes an alloy containing Al, Zn and In, and may further contain one or more of Zr, Si, Ce, Ti and B.

DETAILED DESCRIPTION OF THE PREFERRED EMBODIMENTS

Unless otherwise specified herein, in this specification and in the appended claims all amounts indicated are percent by weight.

In an alloy according to the present invention, both Zn and In function so as to restrict self dissolution of the alloy thus increasing the amount of electricity generated. In a preferred embodiment, if the amount of Zn contained in the alloy is less than about 10%, or if the amount of In contained in the alloy is less than about 0.03%, the above-described function is not sufficiently effected. Also, if the amount of Zn contained in the alloy is more than about 50%, or if the amount of In contained in the alloy is more than about 0.6%, the potential of the anode tends to be too high (too highly positive). In a more preferred embodiment, the amount of Zn contained in the alloy is about 10% to about 40%. In another more preferred embodiment, the amount of Zn is about 10% to about 30%. In a more preferred embodiment, the amount of In contained in the alloy is about 0.05% to about 0.5%. In another more preferred embodiment, the amount of In is about 0.1% to about 0.3%.

In an alloy according to the first preferred aspect of the invention, Zr has the same function as Zn and In. In a preferred embodiment, if the amount of Zr contained in the alloy is less than about 0.0005%, the function of restricting self dissolution is not sufficiently effected. Also, if the amount of Zr contained in the alloy is more than about 0.05%, Zr is distributed in the grain boundary of the alloy in large grains thus reducing the amount of electricity generated. In a more preferred embodiment, the amount of Zr contained in the alloy is about 0.001% to about 0.01%.

In an alloy according to a second preferred aspect of the invention, Si has the same function as Zn and In. In a preferred embodiment, if the amount of Si contained in the alloy is less than about 0.05%, the function of restricting self dissolution is not sufficiently effected. Also, if the amount of Si contained in the alloy is more than about 0.3%, the potential of the anode formed thereof tends to be too high (too highly positive). In a more preferred embodiment, the amount of Si contained in the alloy is about 0.1% to about 0.2%.

In an alloy according to a third preferred aspect of the invention, Ce functions so as to prevent hole-type corrosion of the alloy thus increasing the amount of electricity generated. In a preferred embodiment, if the amount of Ce contained in the alloy is less than about 0.02%, the function is not sufficiently effected. Also, if the amount of Ce contained in the alloy is more than about 0.2%, the potential of the anode formed thereof tends to be too high (too highly positive). In a more preferred embodiment, the amount of Ce contained in the alloy is about 0.05% to about 0.1 5%.

In an alloy according to a fourth preferred aspect of the invention, both Ti and B function so as to prevent hole-type corrosion and groove-type corrosion (corrosion occurring in the form of a groove leaving two sides of the groove uncorroded) of the alloy by making the crystals of the alloy microscopic grains instead of large pillars thus increasing the amount of electricity generated. In a preferred embodiment, if the amount of Ti contained in the alloy is less than about 0.005%, or if the amount of B contained in the alloy is less than about 0.001%, the function is not sufficiently effected. Also, if the amount of Ti contained in the alloy is more than about 0.1%, or if the amount of B contained in the alloy is more than about 0.02%, the amount of electricity generated is reduced. In a more preferred embodiment, the amount of Ti contained in the alloy is about 0.01% to about 0.08%. In another more preferred embodiment, the amount of B is about 0.005% to about 0.01%.

The following examples illustrate numerous embodiments of the present invention.

Preferred Examples 1 Through 11 and Examples 1 Through 10

Twenty-one different types of alloys described in Table 1 were dissolved in the air and molded to obtain rod-shaped ingots, each having a diameter of 25 mm and a length of 250 mm. Each ingot sample was used as a sacrificial anode and tested for performance. The test was performed in accordance with "The Method for Testing a Sacrificial Anode" (*The Method for Testing a Sacrificial Anode and its Detailed Explanation, Corrosion Protection Technology*, Vol. 31, pp. 612–620, 1982, Japanese Society of Corrosion Engineers, Tokyo, Japan) as follows.

Each sample was polished until the surface thereof obtained the roughness equal to that of No. 240 sandpaper and covered with vinyl tape for insulation except for an area of 20 $cm^2$ of the side surface thereof. Next, an aqueous solution having a composition of 32.0 g/l KCl, 24.5 g/l NaOH, 10.0 g/l KOH and 0.1 g/l $Ca(OH)_2$ was filled in a one-liter beaker as a test liquid of concrete. Each sample of the alloy was located at the center of the beaker as an anode, and a cylinder formed of stainless steel was located along the side wall of the beaker as a cathode. (The distance between the anode and the cathode was 30 mm.) The anode and cathode were connected to each other via a DC regulated power supply. Electricity was supplied for 240 hours at a constant current density of 0.1 $mA/cm^2$ at the anode. The amount of electricity generated was obtained by a calculation based on the reduced weight of the sample. The potential of the anode was obtained by measuring the potential of the anode immediately before the electricity supply was stopped and using an electrode formed of silver-silver chloride as a reference. The composition of each sample and the test results are shown in Table 1.

TABLE 1

| Preferred Examples or Examples | Composition (wt %) Zn | In | Al | Performance: Amount of Electricity Generated (A · hr/kg) | Potential of Anode (mV vs. Ag/AgCl) |
|---|---|---|---|---|---|
| Preferred Example 1 | 10 | 0.05 | Balance | 1512 | −1574 |
| Preferred Example 2 | 10 | 0.10 | Balance | 1750 | −1650 |
| Preferred Example 3 | 10 | 0.59 | Balance | 1753 | −1563 |
| Preferred Example 4 | 20 | 0.03 | Balance | 1500 | −1400 |
| Preferred Example 5 | 20 | 0.11 | Balance | 1730 | −1516 |
| Preferred Example 6 | 20 | 0.57 | Balance | 1700 | −1490 |
| Preferred Example 7 | 30 | 0.08 | Balance | 1522 | −1343 |
| Preferred Example 8 | 30 | 0.28 | Balance | 1634 | −1284 |
| Preferred Example 9 | 40 | 0.10 | Balance | 1560 | −1162 |
| Preferred Example 10 | 50 | 0.06 | Balance | 2099 | −1281 |
| Preferred Example 11 | 50 | 0.58 | Balance | 1930 | −1021 |
| Example 1 | 7 | 0.01 | Balance | 379 | −1262 |
| Example 2 | 7 | 0.65 | Balance | 1000 | −980 |
| Example 3 | 10 | 0.02 | Balance | 700 | −1200 |
| Example 4 | 10 | 0.65 | Balance | 1650 | −100 |
| Example 5 | 30 | 0.00 | Balance | 500 | −1147 |
| Example 6 | 30 | 0.70 | Balance | 1700 | 224 |
| Example 7 | 50 | 0.01 | Balance | 483 | −1200 |
| Example 8 | 50 | 0.70 | Balance | 1886 | 340 |
| Example 9 | 60 | 0.05 | Balance | 1984 | −500 |
| Example 10 | 60 | 0.60 | Balance | 2500 | 450 |

Preferred Examples 12 Through 44 and Examples 11 Through 40

Sixty-three different types of alloys were dissolved in air and molded. A performance test of sacrificial anodes was conducted in the same manner as that for Embodiment 1.The composition of each sample and the test results are shown in Tables 2, 3 and 4.

TABLE 2

| Preferred Examples or Examples | Composition (wt %) Zn | In | Si | Al | Performance: Amount of Electricity Generated (A · hr/kg) | Potential of Anode (mV vs. Ag/AgCl) |
|---|---|---|---|---|---|---|
| Preferred Example 12 | 10 | 0.05 | 0.05 | Balance | 1612 | −1555 |
| Preferred Example 13 | 10 | 0.06 | 0.30 | Balance | 1750 | −1630 |
| Preferred Example 14 | 10 | 0.59 | 0.06 | Balance | 1773 | −1550 |

TABLE 2-continued

| Preferred Examples or Examples | Composition (wt %) Zn | In | Si | Al | Performance: Amount of Electricity Generated (A · hr/kg) | Potential of Anode (mV vs. Ag/AgCl) |
|---|---|---|---|---|---|---|
| Preferred Example 15 | 10 | 0.53 | 0.28 | Balance | 1800 | −1440 |
| Preferred Example 16 | 20 | 0.11 | 0.15 | Balance | 1730 | −1456 |
| Preferred Example 17 | 20 | 0.57 | 0.22 | Balance | 1850 | −1395 |
| Preferred Example 18 | 30 | 0.08 | 0.07 | Balance | 1662 | −1303 |
| Preferred Example 19 | 30 | 0.28 | 0.22 | Balance | 1651 | −1179 |
| Preferred Example 20 | 50 | 0.07 | 0.05 | Balance | 1660 | −1123 |
| Preferred Example 21 | 50 | 0.06 | 0.28 | Balance | 2299 | −1081 |
| Preferred Example 22 | 50 | 0.58 | 0.28 | Balance | 2330 | −1011 |
| Example 11 | 7 | 0.01 | 0.01 | Balance | 579 | −1252 |
| Example 12 | 7 | 0.65 | 0.05 | Balance | 1100 | −950 |
| Example 13 | 10 | 0.02 | 0.30 | Balance | 1020 | −905 |
| Example 14 | 10 | 0.65 | 0.35 | Balance | 1750 | −10 |
| Example 15 | 30 | 0.00 | 0.01 | Balance | 905 | −1047 |
| Example 16 | 30 | 0.70 | 0.34 | Balance | 1850 | 357 |
| Example 17 | 50 | 0.01 | 0.04 | Balance | 483 | −1050 |
| Example 18 | 50 | 0.70 | 0.38 | Balance | 1986 | 540 |
| Example 19 | 60 | 0.05 | 0.5 | Balance | 1984 | −100 |
| Example 20 | 60 | 0.60 | 0.35 | Balance | 2800 | 680 |

TABLE 3

| Preferred Examples or Examples | Composition (wt %) Zn | In | Ce | Al | Performance: Amount of Electricity Generated (A · hr/kg) | Potential of Anode (mV vs. Ag/AgCl) |
|---|---|---|---|---|---|---|
| Preferred Example 23 | 10 | 0.05 | 0.05 | Balance | 1612 | −1555 |
| Preferred Example 24 | 10 | 0.06 | 0.20 | Balance | 1750 | −1630 |
| Preferred Example 25 | 10 | 0.59 | 0.06 | Balance | 1773 | −1550 |
| Preferred Example 26 | 10 | 0.53 | 0.18 | Balance | 1800 | −1440 |
| Preferred Example 27 | 20 | 0.11 | 0.15 | Balance | 1730 | −1456 |
| Preferred Example 28 | 20 | 0.57 | 0.12 | Balance | 1850 | −1395 |
| Preferred Example 29 | 30 | 0.08 | 0.07 | Balance | 1662 | −1303 |
| Preferred Example 30 | 30 | 0.28 | 0.20 | Balance | 1651 | −1179 |
| Preferred Example 31 | 50 | 0.07 | 0.03 | Balance | 1660 | −1123 |
| Preferred Example 32 | 50 | 0.06 | 0.18 | Balance | 2299 | −1081 |
| Preferred Example 33 | 50 | 0.58 | 0.18 | Balance | 2330 | −1011 |
| Example 21 | 7 | 0.01 | 0.01 | Balance | 579 | −1252 |
| Example 22 | 7 | 0.65 | 0.01 | Balance | 1100 | −950 |
| Example 23 | 10 | 0.02 | 0.30 | Balance | 1020 | −905 |
| Example 24 | 10 | 0.65 | 0.35 | Balance | 1750 | −10 |
| Example 25 | 30 | 0.00 | 0.01 | Balance | 905 | −1047 |
| Example 26 | 30 | 0.70 | 0.34 | Balance | 1850 | 357 |
| Example 27 | 50 | 0.01 | 0.04 | Balance | 483 | −1050 |

TABLE 3-continued

| Preferred Examples or Examples | Composition (wt %) Zn | In | Ce | Al | Performance: Amount of Electricity Generated (A · hr/kg) | Potential of Anode (mV vs. Ag/AgCl) |
|---|---|---|---|---|---|---|
| Example 28 | 50 | 0.70 | 0.38 | Balance | 1986 | 540 |
| Example 29 | 60 | 0.05 | 0.50 | Balance | 1984 | −100 |
| Example 30 | 60 | 0.60 | 0.35 | Balance | 2800 | 680 |

TABLE 4

| Preferred Examples or Examples | Composition (wt %) Zn | In | Ti | B | Al | Performance: Amount of Electricity Generated (A·hr/kg) | Potential of Anode (mV vs. Ag/AgCl) |
|---|---|---|---|---|---|---|---|
| Pref. Example 34 | 10 | 0.05 | 0.005 | 0.001 | Bal. | 1612 | −1555 |
| Pref. Example 35 | 10 | 0.06 | 0.03 | 0.01 | Bal. | 1750 | −1630 |
| Pref. Example 36 | 10 | 0.59 | 0.006 | 0.001 | Bal. | 1773 | −1550 |
| Pref. Example 37 | 10 | 0.53 | 0.08 | 0.015 | Bal. | 1800 | −1440 |
| Pref. Example 38 | 20 | 0.11 | 0.01 | 0.004 | Bal. | 1730 | −1456 |
| Pref. Example 39 | 20 | 0.05 | 0.004 | 0.004 | Bal. | 1850 | −1395 |
| Pref. Example 40 | 30 | 0.08 | 0.007 | 0.002 | Bal. | 1662 | −1303 |
| Pref. Example 41 | 30 | 0.28 | 0.008 | 0.004 | Bal. | 1651 | −1179 |
| Pref. Example 42 | 50 | 0.07 | 0.008 | 0.004 | Bal. | 1660 | −1123 |
| Pref. Example 43 | 50 | 0.06 | 0.005 | 0.007 | Bal. | 2299 | −1081 |
| Pref. Example 44 | 50 | 0.58 | 0.03 | 0.01 | Bal. | 2330 | −1011 |
| Example 31 | 7 | 0.01 | 0.14 | 0.03 | Bal. | 579 | −1252 |
| Example 32 | 7 | 0.65 | 0.13 | 0.03 | Bal. | 1100 | −950 |
| Example 33 | 10 | 0.02 | 0.14 | 0.03 | Bal. | 1020 | −905 |
| Example 34 | 10 | 0.65 | 0.12 | 0.02 | Bal. | 750 | −10 |
| Example 35 | 30 | 0.00 | 0.003 | 0.0009 | Bal. | 905 | −1047 |
| Example 36 | 30 | 0.70 | 0.003 | 0.0009 | Bal. | 1850 | 357 |
| Example 37 | 50 | 0.01 | 0.015 | 0.0008 | Bal. | 483 | −1050 |
| Example 38 | 50 | 0.70 | 0.05 | 0.009 | Bal. | 1986 | 540 |
| Example 39 | 60 | 0.05 | 0.004 | 0.004 | Bal. | 1984 | −100 |
| Example 40 | 60 | 0.60 | 0.12 | 0.03 | Bal | 1800 | 680 |

An alloy according to the present invention causes electricity generation of an amount as large as 1,500 A·hr/kg or more, and an anode formed of an alloy in accordance with the present invention has a potential as low as −1,000 mV or less. Such an alloy is suitable for corrosion protection of reinforcement in a structure built of reinforced concrete.

In use, methods of application of the alloy to structure include thermal spray, but the alloy could also be applied as a sheet or in strips. Arc spray and flame spray are preferred methods of application. For the thermal spray process, the alloy is cast, extruded to a wire form, drawn into wire of a size suitable for the thermal spray equipment, then sprayed onto the surface of the concrete structure. The alloy bonds with the concrete. An electrical connection is made between the steel embedded into the concrete and the anode. For sheet, plate, and strip forms, the alloy can be cast into the structure or mechanically fastened to the structure, then overcoated with a cementitious overlay.

Although we do not wish to be bound by any theory, one possible explanation of the invention is the following. Electrical current flows from the anode to the embedded steel in sufficient quantity to cause electrochemical polarization of the steel and subsequent protection of the steel from corrosion by moisture and salts.

The present invention also relates to a reinforced concrete structure comprising a cementitious material, metal reinforcement, and a sacrificial anode, said sacrificial anode including an alloy comprising Al, Zn and In. Metal reinforcement includes any metal shaped in such a way so as to provide reinforcement to a cement structure in which it is incorporated. For example, the metal reinforcement includes metal grating, metal sheets and metal rods. The metal may be any metal used for concrete reinforcement, but typically is steel.

The term cementitious material refers to cement compositions. Generally, a cement is any substance that acts as a bonding agent for materials, or any substance that is set and hardened by the action of water. Nonlimiting examples of a cementitious material include the following: cement, hydraulic cement, Portland cement, gas entrained cement, concretes, mortars, plasters and grouts. This list is intended to be merely illustrative and not exhaustive, and the omission of a certain class of cement is not meant to require its exclusion.

While the invention has been shown and described with respect to specific embodiments thereof, this is for the purpose of illustration rather than limitation, and other variations and modifications of the specific embodiments herein shown and described will be apparent to those skilled in the art within the intended spirit and scope of the invention as set forth in the appended claims.

We claim:

1. A reinforced concrete structure comprising a cementitious material, metal reinforcement, and a cathodic protection anode, said anode comprising an alloy of about 20% to about 50% Zn, about 0.2% to about 0.6% In and the balance Al.

2. The reinforced concrete structure of claim 1, wherein said anode is a sacrificial anode electrically connected to the metal reinforcement.

3. The reinforced concrete structure of claim 1, wherein the alloy further comprises Zr.

4. The reinforced concrete structure of claim 1, wherein the alloy further comprises Si.

5. The reinforced concrete structure of claim 1, wherein the alloy further comprises Ce.

6. The reinforced concrete structure of claim 1, wherein the alloy further comprises Ti and B.

7. A reinforced concrete structure comprising a cementitious material, metal reinforcement, and a cathodic protection anode, said anode comprising an alloy of about 10% to about 50% Zn, about 0.2% to about 0.6% In, about 0.02% to about 0.2% Ce and the balance Al.

8. A method of providing cathodic protection to a reinforced concrete structure comprising:

providing a reinforced concrete structure comprising a cementitious material and metal reinforcement, and introducing a cathodic protection anode into the reinforced concrete structure, said anode including an alloy comprising about 20% to about 50% Zn, about 0.2% to about 0.6% In and the balance Al.

9. The method of claim 8, wherein said anode is a sacrificial anode, the method further comprising electrically connecting the sacrificial anode to the metal reinforcement.

10. The method of claim 8, wherein the alloy further comprises at least one of Zr, Si, Ce, Ti and B.

11. A method of providing cathodic protection to a reinforced concrete structure comprising:

providing a reinforced concrete structure comprising a cementitious material and metal reinforcement, and introducing a cathodic protection anode into the reinforced concrete structure, said anode including an alloy comprising about 10% to about 50% Zn, about 0.2% to about 0.6% In, about 0.02% to about 0.2% Ce and the balance Al.

12. A method of making a cathodically protected reinforced concrete structure comprising:

providing a reinforced concrete structure comprising a cementitious material and metal reinforcement;

introducing a sacrificial anode into the reinforced concrete structure, wherein said sacrificial anode includes an alloy comprising about 20 to about 50% of Zn and about 0.2% to about 0.6% of In, with the balance comprising Al; and electrically connecting said sacrificial anode to said metal reinforcement.

13. An alloy for a sacrificial anode comprising about 20% to about 50% of Zn, about 0.2% to about 0.6% In, about 0.0005% to about 0.3% of at least one metal selected from Zr, Si, Ce, Ti, and B, and the balance Al.

14. The alloy of claim 13, comprising about 20% to about 40% of Zn and about 0.2% to about 0.5% of In.

15. The alloy of claim 13, comprising about 20% to about 30% of Zn and about 0.2% to about 0.3% of In.

16. The alloy of claim 13, comprising about 20% of Zn and about 0.2% of In.

17. The alloy of claim 13, comprising about 30% of Zn and about 0.2% of In.

18. The alloy of claim 13, comprising about 40% of Zn and about 0.2% of In.

19. An alloy for a sacrificial anode comprising about 20% to about 50% of Zn, about 0.2% to about 0.6% In, about 0.0005% to about 0.05% of Zr and the balance Al.

20. The alloy of claim 19, comprising about 20% to about 30% of Zn and about 0.2% to about 0.5% of In.

21. The alloy of claim 19, comprising about 0.001% to about 0.01% of Zr.

22. An alloy for a sacrificial anode comprising about 20% to about 50% of Zn, about 0.2% to about 0.6% In, about 0.05% to about 0.3% of Si and the balance Al.

23. The alloy of claim 22, comprising about 20% to about 30% of Zn and about 0.2% to about 0.5% of In.

24. The alloy of claim 22, comprising about 0.1% to about 0.2% of Si.

25. An alloy for a sacrificial anode comprising about 20% to about 50% of Zn, about 0.2% to about 0.6% In, about 0.02% to about 0.2% of Ce and the balance Al.

26. The alloy of claim 25, comprising about 20% to about 30% of Zn and about 0.2% to about 0.5% of In.

27. The alloy of claim 25, comprising about 0.05% to about 0.15% of Ce.

28. An alloy for a sacrificial anode comprising about 20% to about 50% of Zn, about 0.2% to about 0.6% In, about 0.005% to about 0.1% of Ti, about 0.001% to about 0.02% of B and the balance Al.

29. The alloy of claim 28, comprising about 20% to about 30% of Zn and about 0.2% to about 0.5% of In.

30. The alloy of claim 28, comprising about 0.01% to about 0.08% of Ti and about 0.005% to about 0.01% of B.

31. An alloy for a sacrificial anode comprising about 10% to about 50% of Zn, about 0.2% to about 0.6% In, about 0.0005% to about 0.3% of at least one metal selected from Zr, Ce and B, and the balance Al.

32. An alloy for a sacrificial anode comprising about 10% to about 50% of Zn, about 0.2% to about 0.6% In, about 0.0005% to about 0.05% of Zr and the balance Al.

33. An alloy for a sacrificial anode comprising about 10% to about 50% of Zn, about 0.2% to about 0.6% In, about 0.05% to about 0.3% of Si, about 0.02% to about 0.2% Ce and the balance Al.

34. An alloy for a sacrificial anode comprising about 10% to about 50% of Zn, about 0.2% to about 0.6% In, about 0.02% to about 0.2% of Ce and the balance Al.

35. An alloy for a sacrificial anode comprising about 10% to about 50% of Zn, about 0.2% to about 0.6% In, about 0.005% to about 0.1% of Ti, about 0.001% to about 0.02% of B and the balance Al.

* * * * *